US008813402B2

(12) United States Patent
Ponce

(10) Patent No.: US 8,813,402 B2
(45) Date of Patent: Aug. 26, 2014

(54) SYSTEM FOR SECURING ACCESSORIES

(76) Inventor: Norberto Ponce, Rio Hondo, TX (US)

( * ) Notice: Subject to any disclaimer, the term of this patent is extended or adjusted under 35 U.S.C. 154(b) by 0 days.

(21) Appl. No.: 13/215,143

(22) Filed: Aug. 22, 2011

(65) Prior Publication Data

US 2012/0045597 A1 Feb. 23, 2012

Related U.S. Application Data

(60) Provisional application No. 61/376,077, filed on Aug. 23, 2010.

(51) Int. Cl.

| | |
|---|---|
| ***A47C 5/00*** | (2006.01) |
| *A45F 3/00* | (2006.01) |
| *A45C 13/42* | (2006.01) |
| *A45C 13/08* | (2006.01) |
| *A45F 3/04* | (2006.01) |

(52) U.S. Cl.

CPC ..... *A45F 3/00* (2013.01); *A45F 2003/001* (2013.01); *A45C 13/42* (2013.01); *A45C 13/08* (2013.01); *A45F 3/04* (2013.01)

USPC ..... 40/633; 428/542.2; 190/102

(58) Field of Classification Search

USPC ..... 40/657, 6, 633; 2/244; 428/542.2; 190/102

See application file for complete search history.

(56) References Cited

U.S. PATENT DOCUMENTS

| | | | | | |
|---|---|---|---|---|---|
| 5,136,726 | A * | 8/1992 | Kellin et al. | 2/244 |
| D344,624 | S * | 3/1994 | Schnel et al. | D2/629 |
| 5,553,759 | A * | 9/1996 | McMaster et al. | 224/631 |
| 5,673,501 | A * | 10/1997 | Mathews | 36/136 |
| 5,704,067 | A * | 1/1998 | Brady | 2/170 |
| 5,857,220 | A * | 1/1999 | Erny et al. | 2/244 |
| 6,279,168 | B1 * | 8/2001 | Bean | 2/209.13 |
| 2005/0060791 | A1 * | 3/2005 | Garrett | 2/311 |
| 2007/0039086 | A1 * | 2/2007 | Moore | 2/338 |
| 2009/0107021 | A1 * | 4/2009 | Koeppel | 40/657 |
| 2009/0265971 | A1 * | 10/2009 | Cook | 40/633 |
| 2010/0037501 | A1 * | 2/2010 | Danielson | 40/625 |

* cited by examiner

*Primary Examiner* — Gary Hoge

(74) *Attorney, Agent, or Firm* — Cesari & Reed LLP; Kirk A. Cesari

(57) ABSTRACT

The disclosure is related to systems and devices for securing accessories, such as a strap cover. A strap cover may be used with shoulder straps or other carrying straps for backpacks, duffel bags, golf bags, or other containers. A strap cover may be an open sheet with opposite edges that secure to one another around an object, such as a strap, or may be a flattened tubular sleeve that can be passed over an object. A device for securing accessories may have a resilient display panel with a series of accessory attachments or attachment passages. The accessories may comprise any practicable form, with certain accessories having posts with wide flanges extending therefrom that are pushed through the resilient material for capture by the accessory attachment passages.

11 Claims, 5 Drawing Sheets

SYSTEM FOR SECURING ACCESSORIES

CROSS REFERENCE TO RELATED APPLICATION

The present application claims priority to U.S. provisional patent application Ser. No. 61/376,077, filed Aug. 23, 2010, and entitled "STRAP COVER", the content of which is hereby incorporated by reference in its entirety.

BACKGROUND

1. Field of the Invention

The present disclosure is generally related to systems and devices for securing accessories. The systems and devices for securing accessories described herein relate generally to attachment systems for removable installation or attaching of various buttons, emblems, fashion accessories, ornamental articles, or other attachments for display, identification or safety.

2. Description of the Related Art

The use of supporting straps for the carriage of various articles on or by the person has been known for a considerable period of time. Examples of such articles are backpacks, duffel bags and other related containers, golf bags, life jackets, and similarly configured articles. Backpacks have become increasingly popular with students, as school workload has become greater in many cases and students seem to have more things to carry such as laptop or tablet computers, etc.

The majority of student backpacks, as well as duffel bags and similar containers for the carriage of various goods, generally have much the same appearance. Moreover, many such devices are styled after military packs, duffel bags, and the like, and are constructed of materials of drab color or camouflage to simulate their military inspiration. As a result, it can be difficult for a person to select his or her pack or bag from a collection of such packs and bags, without careful scrutiny. Moreover, the often drab color(s) used in the construction of such packs and bags greatly reduces their visibility, particularly in conditions of poor visibility. This can be hazardous to a person carrying such a pack or bag along a roadside in such conditions.

As a result, many students and others who have use of a backpack or other container carried by or on the person, may attempt to personalize the device by adding various embellishments to make their pack or bag stand out from others. Such embellishments may be permanently installed, e.g., iron-on or sewn on appliquks and the like, or removably installed, e.g., pins, buttons, clasps, and the like. While most such embellishments are perhaps installed on the back of the pack or the body of the bag, it may be desirable to install them on the shoulder strap(s) or other carrying strap(s) as well.

A problem with conventional backpacks, duffel bags, and other containers and devices, is that they do not provide any specialized surface for the installation of such accessories. A pack or other container that has had permanent appliques or the like installed thereon is forever marked by such devices even when the user of the device wishes to change its appearance, e.g., when passing it to a younger sibling, changing schools, etc. Even temporarily installed pins, clasps, etc. can require the material of the pack or bag to be penetrated by a pin or the like, thus possibly damaging the material if a relatively large hole must be made for a large diameter attachment post. This may be particularly critical in an area of high stress, such as a shoulder strap or carrying strap. Moreover, a person who collects a large number of various clasps, pins, and the like will find it a tedious task to remove all of these devices when he or she moves to a different pack or bag, and then has to reattach these devices individually to the new pack or bag.

A few shoulder strap covers and pads have been developed in the past, for various purposes. An example of such is found in Japanese Patent Publication No. 2005-336,692, published on Dec. 8, 2005, which shows a wraparound cover for attachment around the strap of a bra, slip, or other undergarment to conceal the strap. The device is secured by hinged, mating pinch-type clip components installed upon the inner surface of the cover.

SUMMARY

A system for securing accessories may comprise a pliable sheet or sleeve for removable placement around or over an object, such as a shoulder strap or other carrying strap of a backpack, duffel bag, golf bag, luggage bag, or other container or device. One embodiment of a system for securing accessories may comprise a sheet of material having a center panel of resilient material (e.g., soft plastic, neoprene, etc.) having attachment mechanisms for attaching devices and laterally opposed extensions of durable fabric. The fabric extensions can include mating attachments for securing to one another. Another embodiment may comprise a tubular sleeve formed of a resilient material having attachment mechanisms for attaching devices.

The central or display panel of a system for securing devices can include mechanisms for removably attaching or securing various decorative, functional, or other attachments thereto, e.g., holes or passages for the insertion of posts of various buttons and the like, hook and loop fabric material for the attachment of devices having mating material thereon, etc. The system may be formed of a reflective or luminescent material if so desired, and/or may provide for the attachment of reflective or luminescent devices thereto. Such reflective or luminescent attachments may serve well when used as a strap cover over the supporting shoulder strap of a musical instrument, such as a guitar. Alternatively or in addition to the above, the strap cover may be used for the carriage of various audible alarm devices as well, e.g., acoustic bells serving to alert wildlife when hiking, water activated alarms for attachment to a life jacket strap or the like, etc.

DETAILED DESCRIPTION

In the following detailed description of the embodiments, reference is made to the accompanying drawings which form a part hereof, and in which are shown by way of illustration of specific embodiments. It is to be understood that other embodiments may be utilized and structural changes may be made without departing from the scope of the present disclosure. While the terms "strap cover" and "cover" are used herein, the systems and devices disclosed herein are not limited to be used with straps or as covers; instead, a strap cover or cover may be attached to anything that is practicable for attaching.

Figure 1:
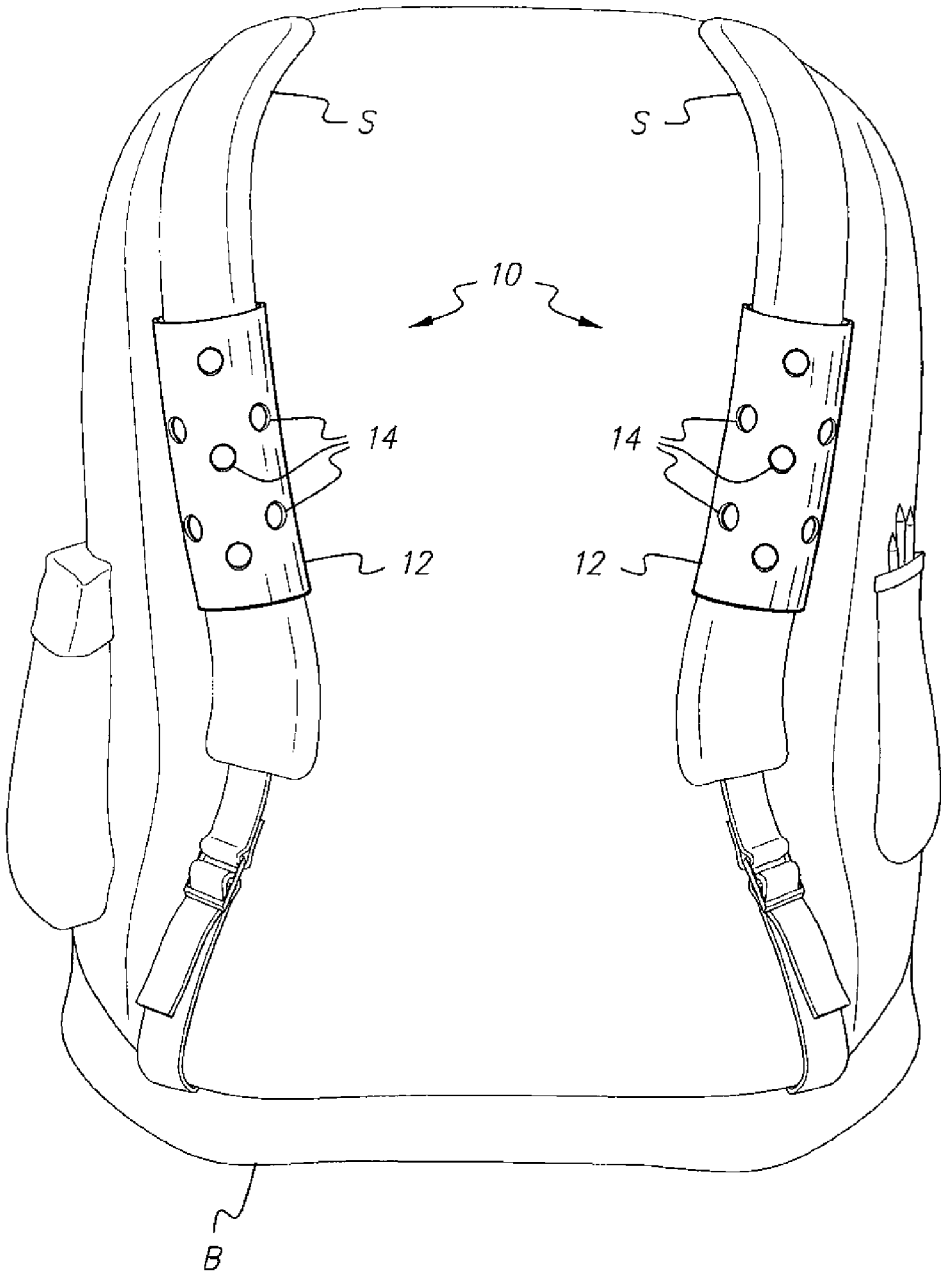
FIG. 1 is a diagram of an illustrative embodiment of a system for securing accessories particularly suitable as attachments to shoulder straps of a backpack.

Referring to FIG. 1, a particular embodiment of a system for securing accessories, such as particularly suitable as attachments to shoulder straps of a backpack. The system for securing accessories may be attachable to a strap and can include various embodiments adapted for removable installation to a shoulder strap, carrying strap, etc. of a backpack, duffel bag, golf bag, or other container or article. The system for securing accessories can include one or more mechanisms for attaching and removing, repeatedly if desired, various buttons, emblems, fashion accessories, ornamental articles, or other attachments for display, identification, or safety.

Figure 2:
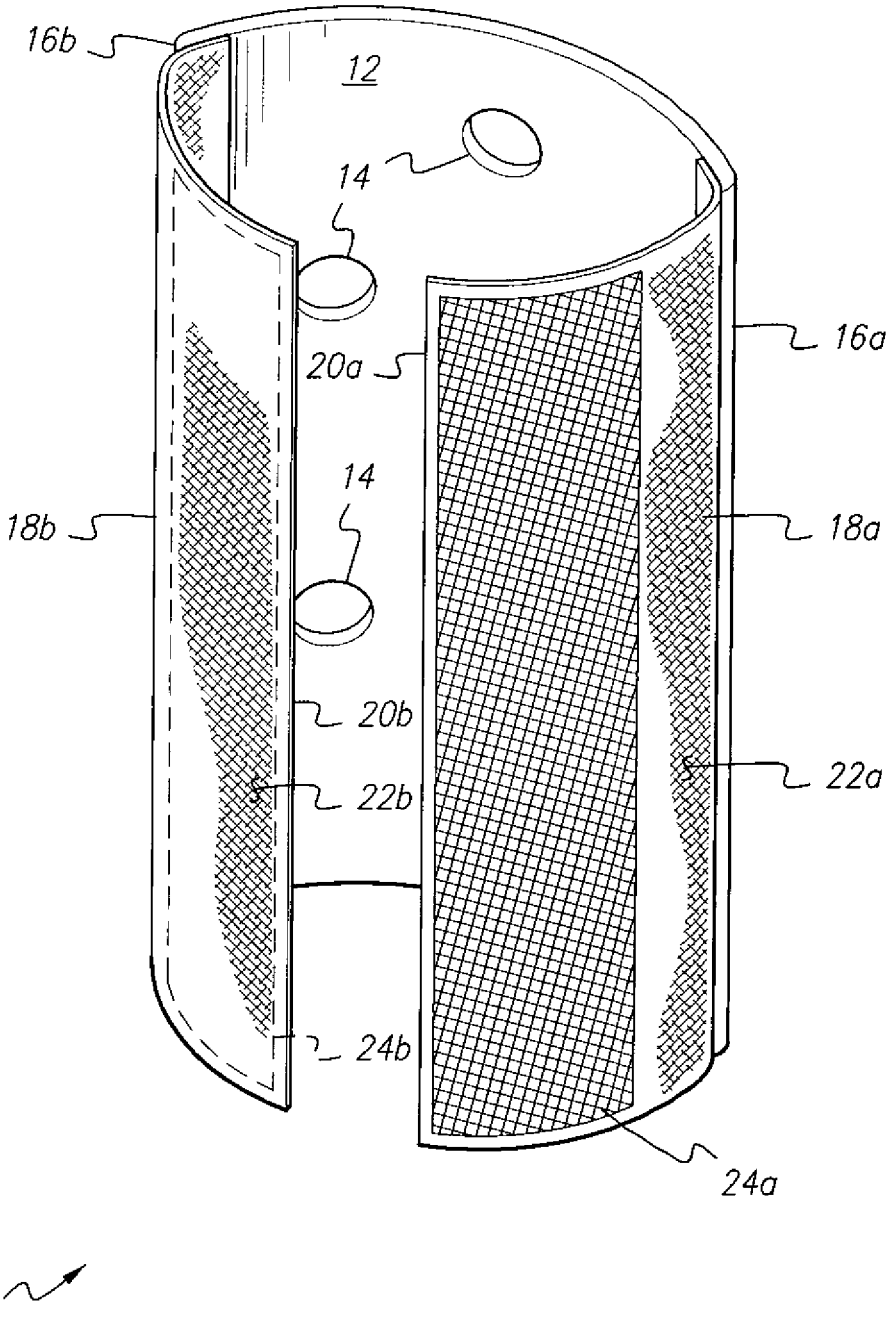
FIG. 2 is a diagram of an illustrative embodiment showing a rear perspective of a system for securing accessories.
Figure 3:
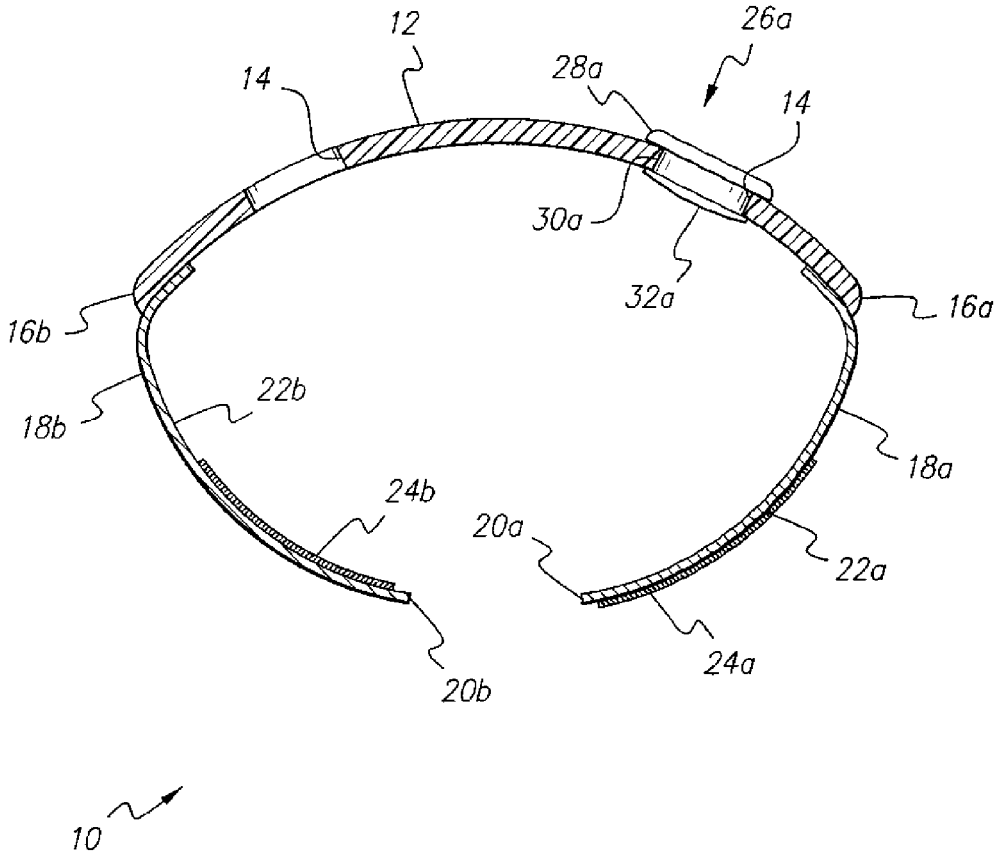
FIG. 3 is a diagram of an illustrative embodiment showing a top view perspective of a system for securing accessories.

FIG. 1 shows an embodiment of a system for securing accessories in the form of strap covers 10 installed upon the left and right shoulder straps S of a backpack B, with FIGS. 2 and 3 show further details of the strap cover 10. The strap cover 10 can include a display panel 12 that may be positioned forwardly to be displayed when the cover 10 is attached to a strap 5, as shown in FIG. 1. The display panel 12 may be formed of a sheet of resilient material, e.g., neoprene, soft plastic, foam resin (such as ethylene-vinyl acetate (EVA)), closed cell resin, open cell resin, rubber or rubber-type materials, neoprene or the like. In some embodiments, the display panel 12 may have a thickness of about an eighth of an inch, though it could be more or less. Other materials may be used as desired, so long as they provide the required properties to allow attachment of the various devices. The display panel 12 can include a series of accessory attachment holes or passages 14 formed therethrough to allow the removable installation (i.e. allowing attachment and removal of devices as many times as desired) of various attachments, buttons, or the like to the panel 12, as described further below.

The display panel 12 may have mutually opposed first and second edges, respectively 16*a* and 16*b*, with mutually opposed first and second attachment panels 18*a* and 18*b* extending from the respective display panel edges 16*a* and 16*b* as shown in FIGS. 2 and 3. The attachment panels 18*a* and 18*b* are preferably formed from a durable fabric material, e.g., denim, canvas, Nylon duck, etc. Any practicable material may be used as desired, however. Each of the attachment panels 18*a* and 18*b* can have a distal edge, respectively 20*a* and 20*b*, with an attachment surface, respectively 22*a* and 22*b*, adjacent the corresponding distal edge. The two attachment surfaces 22*a* and 22*b* are opposite one another, i.e., one of the attachment surfaces is on the outer surface of its attachment panel and the opposite attachment surface is on the inner surface of its attachment panel. It is not critical as to which attachment surface is disposed outwardly or inwardly, so long as they are opposite.

Each attachment surface 22*a* and 22*b* can include some attachment mechanisms thereon, with the two attachment mechanisms cooperating with one another to allow the two attachment surfaces 22*a* and 22*b* to connect to one another for securing the strap attachment 10 about a strap S. The attachment mechanisms may comprise mating first and second panel attachments 24*a* and 24*b* of mating hook and loop fabric material, e.g., Velcro®, or some other alternative mating attachments, e.g., snaps, etc., as desired. The panel attachments 24*a* and 24*b* may extend continuously for the length of the strap attachment 10, as shown in FIG. 2, or may alternatively comprise one or more shorter segments, as desired. The two attachment panels 18*a* and 18*b* can be wrapped around the back of the strap S to position the display panel 12 to the front of the strap, and the two panel attachments 24*a* and 24*b* may be secured to one another across the back of the strap S to install the strap cover 10 to the strap S generally as shown in FIG. 1.

The attachment panels 18*a* and 18*b* or the display panel 12 may include a logo, trademark, endorsement, or other advertising. For example, the colors of the attachment panels 18*a* and 18*b* and the display panel 12 may be coordinated to those of a sports team and a logo or name of the sports team may be placed thereon, such as for professional, college, or high school sports. In another example, wording or phrases may be added to the attachment panels 18*a* and 18*b* or the display panel 12.

FIG. 3 provides a plain view in section to show the installation of a display accessory 26*a* through one of the display attachment holes or passages 14 of the strap cover 10. The display accessory 26*a* may comprise a button or button-like device having a display head or component 28*a* disposed to the outer or display surface of the display panel 12. A relatively large diameter post 30*a* can extend from the rear of the display head 28*a* and terminate in a larger diameter flange 32*a*. The diameters of the accessory attachment holes 14 may be about equal to, or slightly smaller than, the diameter of the post 30*a*, with the retaining flange 32*a* of the display accessory 26*a* having a significantly larger diameter than the holes or passages 14. The resilient nature of the material of which the display panel 12 is made, allows the material to distend to allow the retaining flange 32*a* of the button or accessory 26*a* to be pushed through the hole or passage 14. The resilient material then closes up around the post 30*a* and behind the flange 32*a* to capture the accessory 26*a* within the hole or passage 14. The accessory 26*a* is easily removed by pushing its retaining flange 32*a* back through the hole or passage 14 from the rear. Alternatively, the soft plastic or neoprene material of which the display panel 12 is formed, allows it to be penetrated by a sharp point to allow the installation of such conventional devices as tie tacks, lapel pins, etc. to the strap cover 10.

Figure 4:
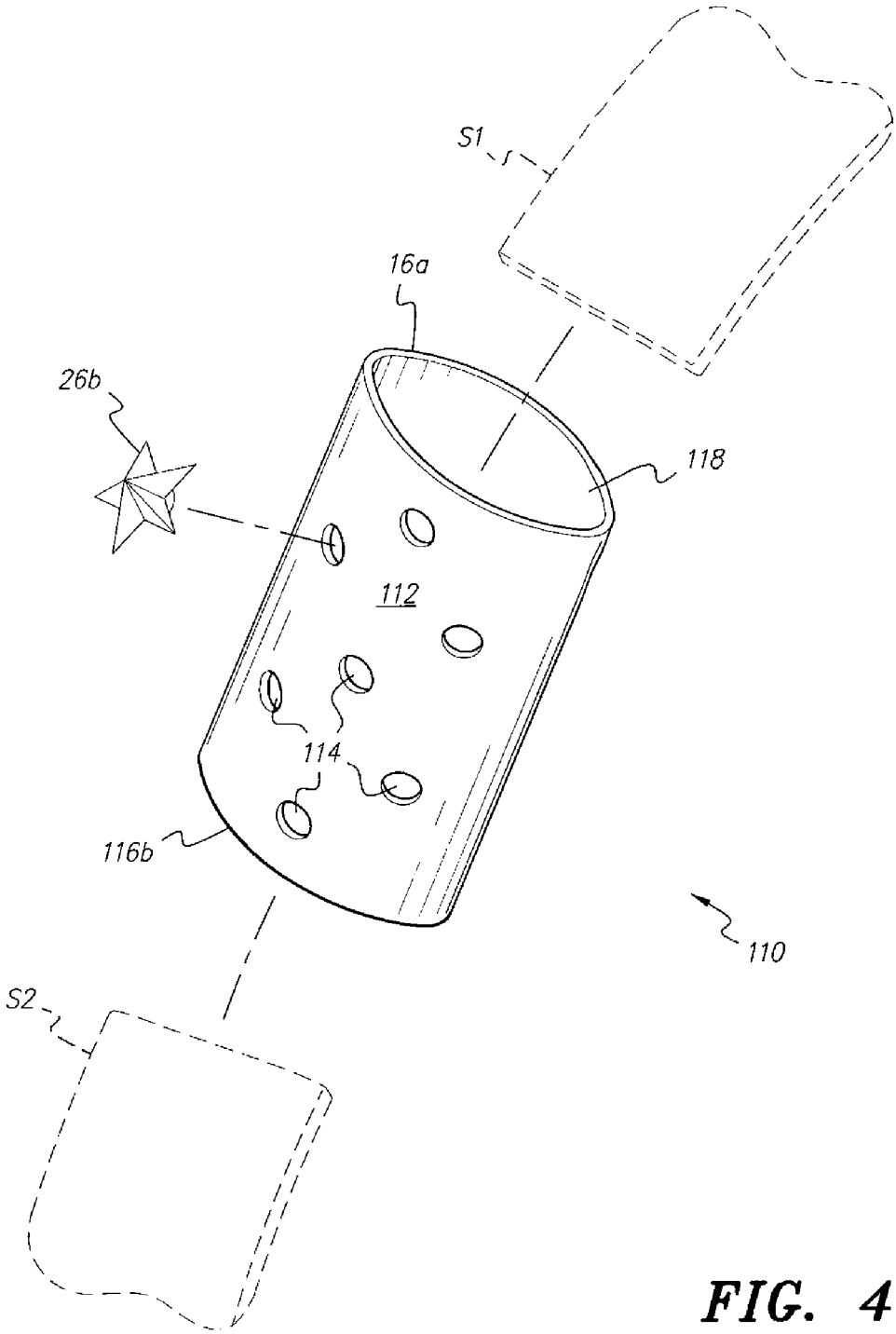
FIG. 4 is a diagram of another illustrative embodiment of a system for securing accessories.

FIG. 4 of the drawings illustrates an alternative embodiment, designated as strap cover 110. The strap cover 110 comprises a circumferentially closed, flattened tube of resilient material, the material corresponding to the resilient material of which the central display panel 12 of the strap cover 10 is formed. However, rather than being formed of multiple components of differing materials, the strap cover 110 is formed as a single, unitary structure of homogeneous material. The display panel 112 of the strap cover 110 is the front panel of the flattened tubular structure, with the display panel 112 having a series of accessory attachment holes or passages 114 formed therethrough, as in the attachment passages 14 of the strap cover 10 of FIGS. 1 through 3. A display accessory 26*b* is shown in FIG. 4, with the accessory 26*b* securing to the display panel 112 in the same manner as described above for securing the display accessory 26*a* to the display panel 12 of the strap cover 10 of FIGS. 1 through 3. As in the case of the strap cover 10 of FIGS. 1 through 3, the material of which the cover 110 is formed allows the installation of conventional pins and the like having sharp attachment points as well.

As the tubular cover 110 is closed about its circumference, the opposite first and second ends 116*a* and 116*b* may be open, with the tubular configuration of the strap cover 110 defining a strap passage 118 therethrough to serve as the strap attachment mechanisms. The tubular strap cover 110 can be installed by first separating or disconnecting the strap, e.g., unbuckling a conventional connecting adjustment buckle, etc., and then passing one of the two strap ends S1 or S2 completely through the strap passage 118 to extend from the opposite end. The two strap ends S1 and S2 are then reconnected conventionally to complete the strap cover 110 installation. Removal is accomplished by reversing the above procedure.

Figure 5:
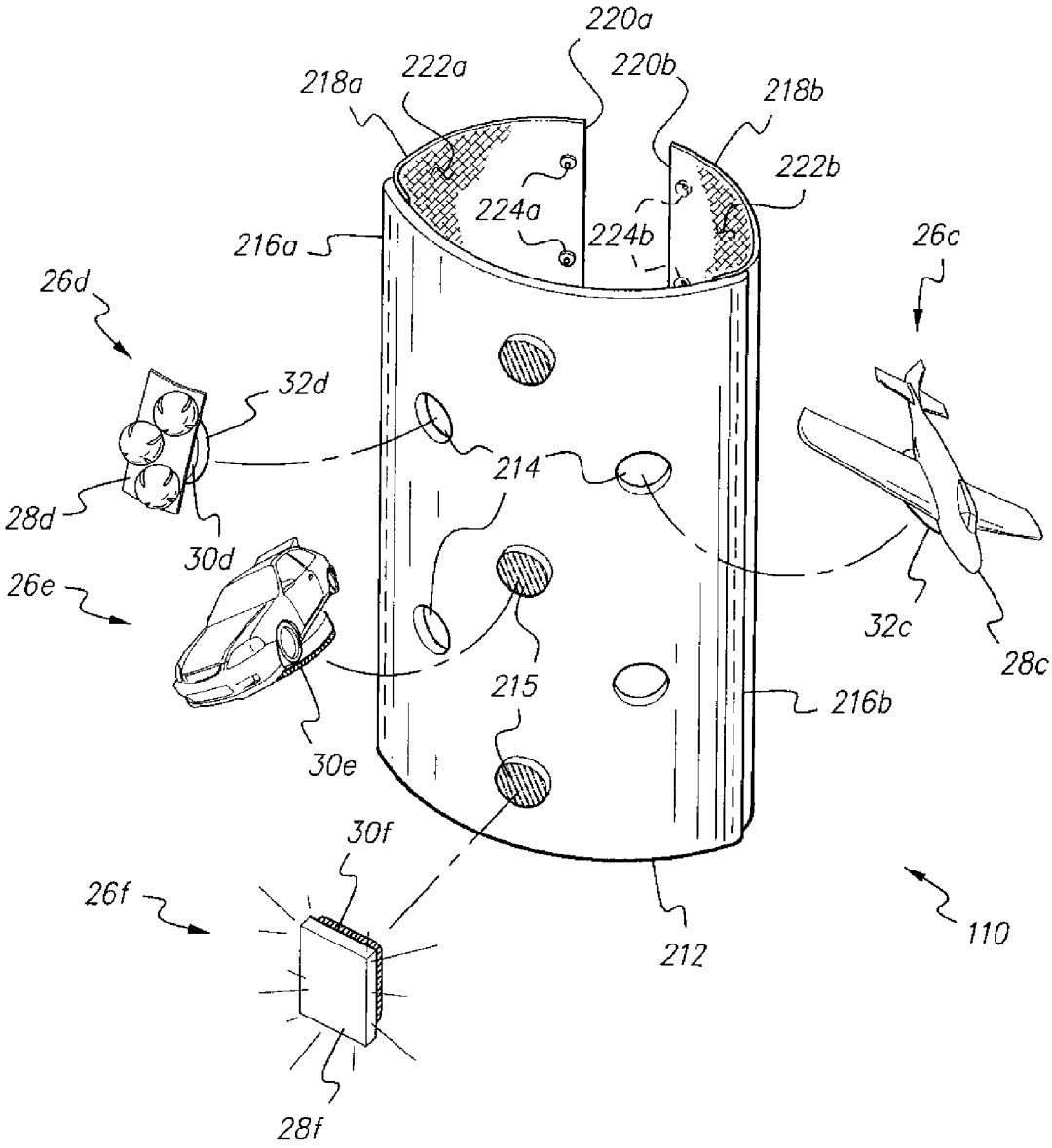
FIG. 5 is a diagram of another illustrative embodiment of a system for securing accessories.

FIG. 5 of the drawings is an exploded front perspective view of a third embodiment of the strap cover, designated as strap cover 210. The strap cover 210 has the same basic configuration as the strap cover 10 of FIGS. 1 through 3, i.e., having a central display panel 212 with at least one (and preferably a plurality of) accessory attachment passage(s) 214. The display panel 212 has mutually opposed first and second edges 216*a*, 216*b*, from which corresponding first and second attachment panels 218*a* and 218*b* extend. The attachment panels 218*a* and 218*b* have respective distal edges 220*a* and 220*b* and corresponding attachment surfaces 222*a* and 222*b* adjacent those edges. The two attachment surfaces 222*a* and 222*b* are opposite one another to allow them to overlap when the strap cover 210 is closed about a strap, as in the case of the strap cover 10 of FIGS. 1 through 3.

Rather than using mating hook and loop fabric material as the attachment mechanisms, the cover 210 incorporates mating snap components, respectively 224*a* and 224*b*. The two attachment panels 218*a* and 218*b* are wrapped around the back of the strap to position the central display panel 212 to the front of the strap, and the panel attachment snaps 224*a* and 224*b* are secured to one another across the back of the strap to install the strap cover 210 to the strap, generally as shown for the first embodiment strap cover 10 of FIG. 1.

The strap cover 210 of FIG. 5 can differ further from the strap cover 10 of FIGS. 1 through 3 in that the strap cover 210 may include different means of accessory attachment from the strap cover 10. In addition to its accessory attachment holes or passages 214, the strap cover 210 can include one or more accessory attachment patches 215 of hook and loop fabric material. Various accessories having compatible attachment means may be removably secured to the patches 215 as desired; examples of such are described further below. Alternatively, the front central display panel 212 may include other accessory attachment means as desired, e.g., snap components as used for the panel attachment snaps 224*a* and 224*b*, etc.

The illustration of FIG. 5 includes two accessory attachments adapted for removable installation in corresponding accessory attachment passages 214 of the strap cover 210. Each of these accessories 26*c* and 26*d* is configured generally like the accessories 26*a* and 26*b* respectively of FIGS. 3 and 4, i.e., having a display head, respectively 28*c* and 28*d*, a post (30*d* shown partially for the accessory 26*d*), and a flange, respectively 32*c* and 32*d*. These accessories 26*c* and 26*d* attach removably to the central panel 212 of the strap cover 210 in the same manner as described further above for the accessories 26*a* and 26*b* illustrated respectively in FIGS. 3 and 4.

While the accessory 26*c* is an ornamental device, it will be seen that functional devices may be installed upon any of the strap cover embodiments described herein, if so desired. The accessory 26*d* is an example of such a functional device, with the display head 28*d* of the device comprising a series of bells. It is desirable at times to produce some form of warning sound or noise, e.g. when hiking in locations where potentially dangerous animals may reside. So-called "bear bells" are sold to hikers for such use, with the bells being attached to the backpack or clothing of the hiker and jingling as the hikers walk, to alert animals to the approach of the hiker and provide the animals with time to leave the area, rather than being taken by surprise as the hiker stumbles upon the animal(s). The bells of the accessory 26*d* provide this function, and may be attached removably to the strap cover 210 of FIG. 5 or to other strap cover embodiments of the present invention. Other audible accessories may be removably attached to any of the strap cover embodiments as desired, e.g., a water-activated alarm for use with a life jacket or the like. The water-activated alarm may be attached to the strap cover, with the strap cover then being secured to the conventional strap or belt of a life jacket to alert a guardian(s) in the event that the wearer of the life jacket falls into the water (pool, etc.).

The two accessories 26*e* and 26*f* are adapted to secure removably to the display panel 212 of the strap cover 210 by mating hook and loop fastener components. The accessories 26*e* and 26*f* each have a backing or display panel attachment patch of hook and loop fabric material, respectively 30*e* and 30*f*, adapted to attach removably to any of the hook and loop fabric patches 215 of the strap cover 210 of FIG. 5. Any mating attachment mechanism, e.g., male and female snaps, etc., may be used to attach any of the accessories to any of the strap covers, so long as the attachment mechanism are compatible between the strap cover and the corresponding accessory.

The use of the strap cover for the attachment of a functional accessory, e.g., the bells of the accessory 26*d*, has been described further above. It will be seen that such functional accessories are not limited to audible devices. FIG. 5 also shows an accessory 26*f* having a luminous display head 28*f*. The display head 28*f* may be phosphorescent, chemiluminescent, or may comprise an electrically excited or powered illumination device powered by a small watch battery, hearing aid battery or the like. Such a luminescent accessory 26*f* may be valuable for use when walking in low visibility conditions in or near traffic. Another example of such use might be a performer, who could install such a luminescent device (s) on a strap cover for installation on the support strap of a musical instrument (e.g., guitar, etc.) when performing. While the luminescent accessory 26*f* of FIG. 5 is shown with a hook and loop fabric attachment backing 30*f*, it will be seen that it could be constructed with the post and flange backing of other accessories, e.g., the accessories 26*c* and 26*d* of FIG. 5, or with other attachment mechanism as desired.

It will be seen that the various features of any of the embodiments described herein may be combined in any practicable manner as desired. For example, the strap cover embodiments 10 and 110 of FIGS. 1 through 3 may include the hook and loop fabric patches of the strap cover embodiment 210 of FIG. 5 in addition to or in lieu of their accessory attachment passages, if so desired. Alternatively, the strap cover embodiment 210 of FIG. 5 could be configured in the form of the circumferentially closed device 110 of FIG. 3, if so desired. Accordingly, the strap cover in any of its embodiments provides a convenient means for the attachment and display of any number of different accessories to the strap of a backpack, luggage, golf bag, instrument, or any other device as practicable to attach the strap cover.

In a further example, a strap cover embodiment may be made of a single, unitary structure of homogeneous material, such as in the example discussed above for FIG. 4; however, instead of the strap cover being a tube, the strap cover may include two distal edges that can be joined near each other via a fastening device, such as snaps or hook and loop fastener components or notches, such as in the example of FIGS. 1 through 3 and FIG. 5.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Moreover, although specific embodiments have been illustrated and described herein, it should be appreciated that any subsequent arrangement designed to achieve the same or similar purpose may be substituted for the specific embodiments shown.

This disclosure is intended to cover any and all subsequent adaptations or variations of various embodiments. Combinations of the above embodiments, and other embodiments not specifically described herein, will be apparent to those of skill in the art upon reviewing the description. Additionally, the illustrations are merely representational and may not be drawn to scale. Certain proportions within the illustrations may be exaggerated, while other proportions may be reduced. Accordingly, the disclosure and the figures are to be regarded as illustrative and not restrictive.

What is claimed is:

1. A device comprising:

a display panel of resilient material, the display panel including attachment mechanisms adapted to allow attachment of multiple accessories to the display panel;

the attachment mechanisms comprise resilient holes in the resilient material and multiple separate accessories can be simultaneously attached to the resilient material through the resilient holes;

a fastener to selectively attach and remove the display panel on an object;

first and second attachment panels of durable fabric material extending from the display panel, each of the attachment panels having a distal edge; and the fastener comprises a first fastener piece disposed on the first attachment panel and a second fastener piece disposed upon the second attachment panel;

wherein the first fastener piece and the second fastener piece can be coupled together to allow the first attachment panel and the second attachment panel to be wrapped about an object.

2. The device of claim 1 further comprising the display panel having mutually opposed first edge and second edge and the first attachment panel extends from the first edge and the second attachment panel extends from the second edge.

3. The device of claim 1 wherein the resilient material comprises foam resin.

4. The device of claim 1 wherein the fastener comprises a hook and loop closure system.

5. The device of claim 1 wherein the fastener comprises a snap closure system.

6. The device of claim 1 wherein the accessories comprise ornamental devices.

7. The device of claim 1 wherein the accessories comprise at least one functional device.

8. The device of claim 1 wherein the display panel comprises a material of closed cell resin.

9. The device of claim 1 wherein the accessories further comprise a display head, a post having a first diameter, the post extending from the rear of the display head and terminating in a flange having a second diameter, and the second diameter is larger than the first diameter.

10. The device of claim 9 wherein the resilient holes have a third diameter that is smaller than the second diameter of the flange, where the resilient holes allow the resilient material to distend to allow a flange of an accessory to be pushed through a resilient hole and the resilient material then closes around the post and behind the flange to capture an accessory within a resilient hole.

11. The device of claim 1 wherein the display panel of resilient material comprises a single, unitary structure of homogeneous material.

* * * * *